US006196472B1

(12) United States Patent
Cooke

(10) Patent No.: US 6,196,472 B1
(45) Date of Patent: Mar. 6, 2001

(54) FUEL INJECTOR

(75) Inventor: Michael Peter Cooke, Gillingham (GB)

(73) Assignee: Lucas Industries, London (GB)

( * ) Notice: Subject to any disclaimer, the term of this patent is extended or adjusted under 35 U.S.C. 154(b) by 0 days.

(21) Appl. No.: 09/251,109

(22) Filed: Feb. 16, 1999

(30) Foreign Application Priority Data

Feb. 19, 1998 (GB) ..... 9803557
Mar. 25, 1998 (GB) ..... 9806273

(51) Int. Cl.[7] ..... F02M 47/02

(52) U.S. Cl. ..... 239/88; 239/90; 239/93; 239/95; 239/533.2; 239/102.2

(58) Field of Search ..... 239/88, 89, 90, 239/91, 92, 93, 94, 95, 96, 533.2, 102.2

(56) References Cited

U.S. PATENT DOCUMENTS

| | | | | |
|---|---|---|---|---|
| 4,022,166 | | 5/1977 | Bart | 123/32 |
| 4,579,283 | * | 4/1986 | Igashira et al. | 239/88 |
| 4,909,440 | * | 3/1990 | Mitsuyasu et al. | 239/96 |
| 5,335,861 | * | 8/1994 | Matusaka | 239/533.7 |
| 5,452,858 | * | 9/1995 | Tsuzuki et al. | 239/533.8 |
| 5,694,903 | * | 12/1997 | Ganser | 239/96 X |
| 5,697,554 | | 12/1997 | Auwaerter et al. | 239/88 |
| 5,803,361 | * | 9/1998 | Horiuchi et al. | 239/88 |
| 5,860,597 | * | 1/1999 | Tarr | 239/88 X |

FOREIGN PATENT DOCUMENTS

| | | |
|---|---|---|
| 197 02 066 | 7/1998 | (DE) . |
| 0 889 230 | 1/1999 | (EP) . |

* cited by examiner

*Primary Examiner*—Andres Kashnikow
*Assistant Examiner*—Robin O. Evans
(74) *Attorney, Agent, or Firm*—Wells, St. John, Roberts, Gregory & Matkin, P.S.

(57) ABSTRACT

A fuel injector comprises a valve needle slidable within a bore and engageable with a seating to control the supply of fuel to an outlet opening, an end surface of the valve needle being exposed to the fuel pressure within a control chamber defined, in part, by a piston member moveable under the influence of a piezoelectric actuator. The control chamber may be supplied with fuel under pressure, in use, through a restricted flow path. The piston member may have an effective area exposed to the pressure within the control chamber which is greater than that of the needle.

5 Claims, 8 Drawing Sheets

FUEL INJECTOR

This invention relates to a fuel injector for use in supplying fuel under pressure to an internal combustion engine. In particular, the invention relates to a fuel injector including a valve needle moveable under the control of a piezoelectric actuator.

It is desirable to use a piezoelectric actuator of the type which expands when energized to control the operation of a fuel injector. Common rail injectors usually require retraction of a valve needle from its seating to allow injection of fuel. It is an object of the invention to provide a fuel injector arranged to be actuated by a piezoelectric actuator of the type which expands when energized.

In order to minimize the stack height of the piezoelectric actuator of such an injector, it is desirable to provide an arrangement whereby the expansion and contraction of the piezoelectric actuator, in use, is amplified resulting in movement of the valve needle of the injector through a distance greater than the distance over which an end part of the actuator moves.

According to an aspect of the invention there is provided a fuel injector comprising a valve needle slidable within a bore and engageable with a seating to control the supply of fuel to an outlet opening, an end surface of the valve needle being exposed to the fuel pressure within a control chamber defined, in part, by a piston member moveable under the influence of a piezoelectric actuator, wherein the control chamber is supplied with fuel under pressure, in use, through a restricted flow path.

The restricted flow path conveniently takes the form of a controlled leakage path between the valve needle and the bore. Alternatively, a separate drilling may be provided to permit the supply of fuel to the control chamber at a restricted rate.

The supply of fuel to the control chamber, in use, acts to urge the needle towards its seating thus preventing continuous injection in the event of failure of the actuator or the associated drive circuit.

According to another aspect of the invention there is provided a fuel injector comprising a valve needle slidable within a bore and engageable with a seating to control the supply of fuel to an outlet opening, a surface associated with the valve needle being exposed to the fuel pressure within a control chamber defined, in part, by a first piston member moveable under the influence of a piezoelectric actuator, wherein the effective area of the first piston member exposed to the fuel pressure within the control chamber is greater than the corresponding area of the said surface associated with the valve needle.

Such an arrangement is advantageous in that the travel of the valve needle is greater than the movement of the piston, thus a greater level of valve needle travel can be achieved for a piezoelectric actuator of a given stack height.

The injector preferably further comprises a shield member shielding part of the valve needle from the fuel pressure within the control chamber. The shield member may comprise a second piston member located within a bore provided in the valve needle. Alternatively, the shield member may take the form of a sleeve through which part of the valve needle extends. The shield member may be moveable with the first piston member, or may alternatively be fixed relative to the body of the injector.

According to a further aspect of the invention there is provided a drive circuit for a piezoelectrically actuated injector, the drive circuit including at least one by-pass resistor arranged to ensure that, upon switching off of an associated engine, the actuator of the injector remains actuated for a sufficiently long duration to allow the fuel pressure applied to the injector to decay.

The invention will further be described, by way of example, with reference to the accompanying drawings, in which.

Figure 1:
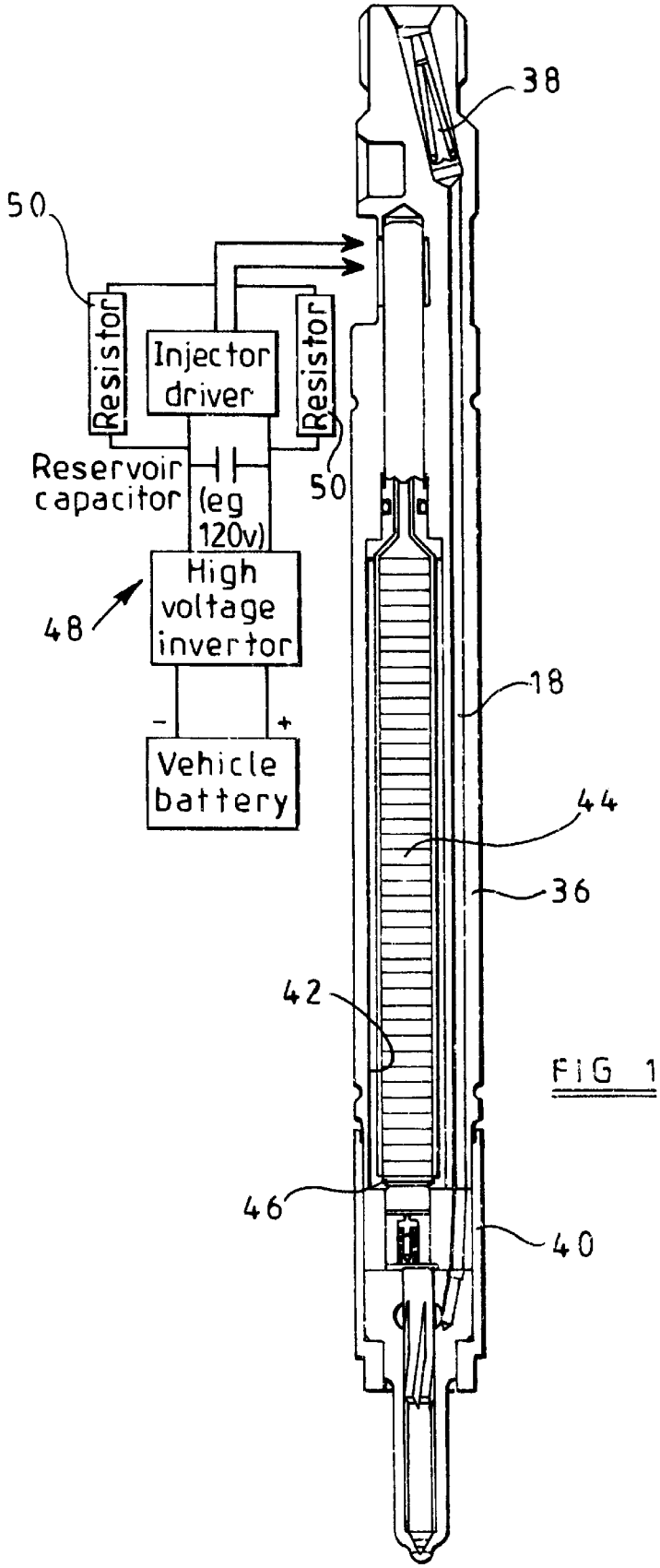
FIG. 1 is a sectional view of a fuel injector in accordance with an embodiment of the invention.
Figure 2:
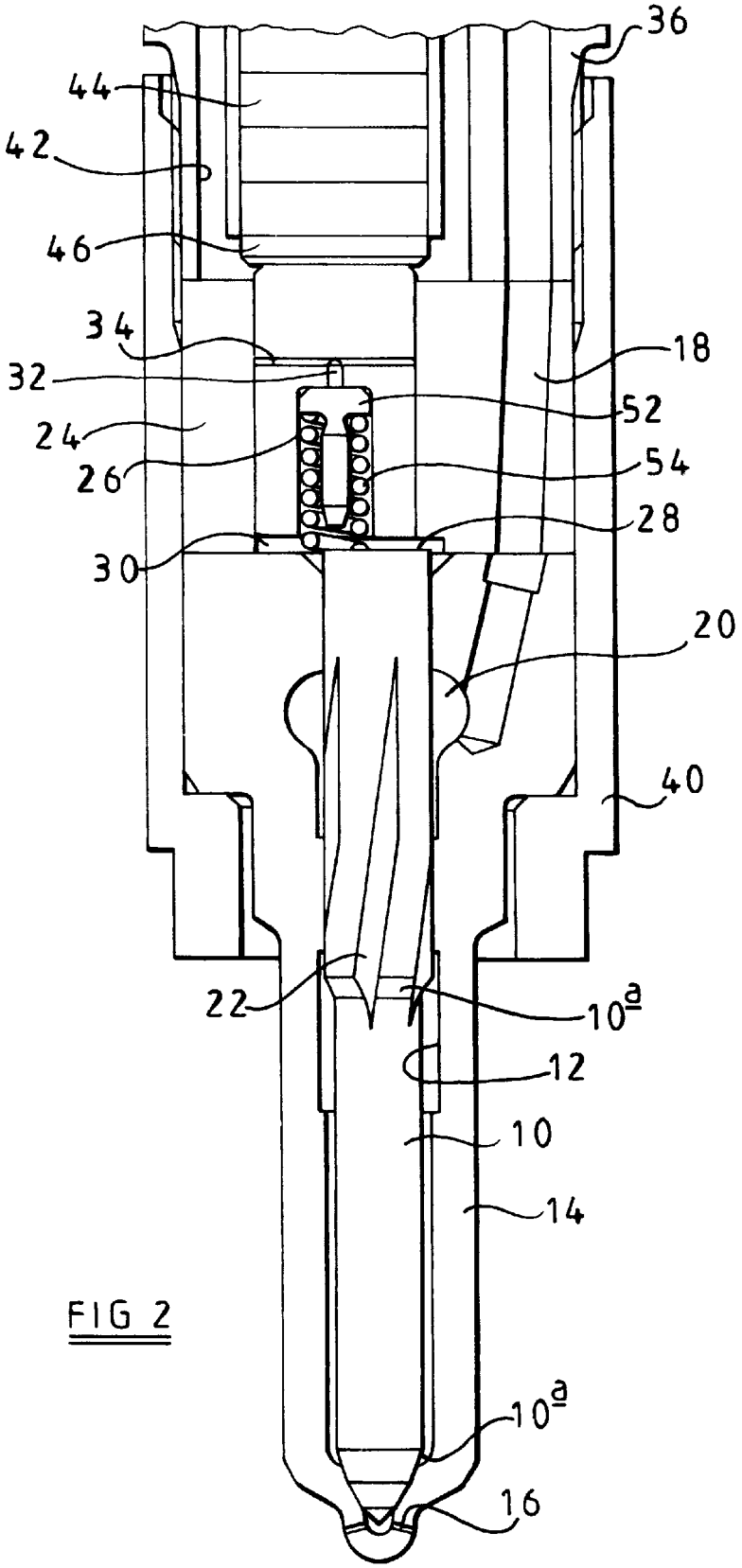
FIG. 2 is an enlarged view of part of the injector of FIG. 1.

The injector illustrated in FIGS. 1 and 2 comprises a valve needle 10 slidable within a bore 12 formed in a nozzle body 14. The bore 12 is a blind bore, the blind end of the bore 12 defining a seating with which an end region of the valve needle 10 is engageable to control the supply of fuel from the bore 12 past the seating to a plurality of outlet openings 16. The bore 12 is arranged to be supplied with fuel from a source of fuel under high pressure, for example a common rail or accumulator, through a supply passage 18 which communicates with an annular gallery 20 defined by part of the bore 12. The valve needle 10 is of stepped form and includes an upper end region of diameter substantially equal to the diameter of the adjacent part of the bore 12, and a lower region which is of diameter smaller than the diameter of the bore 12. In order to permit fuel to flow from the annular gallery 20 to the part of the bore 12 containing the reduced diameter region of the valve needle 10, the valve needle 10 is provided with flutes 22. The shape of the valve needle 10 is such as to include thrust surfaces 1O*a* orientated such that the application of fuel under pressure to the bore 12 applies a force to the needle 10 urging the needle 10 away from its seating.

The upper end of the nozzle body 14 abuts a distance piece 24 which is provided with a through bore offset from the axis of the valve needle 10. A piston member 26 is slidable within the bore of the distance piece 24, the bore of the distance piece 24, the piston member 26, and an upper surface 28 of the valve needle 10 together defining a control chamber 30. In use, fuel is able to flow at a restricted rate from the annular gallery 20 to the control chamber 30 between the valve needle 10 and the adjacent part of the wall of the bore 12. It will be appreciated that such fuel flow is at a restricted rate as the diameters of the needle 10 and the adjacent part of the bore 12 are substantially equal.

The piston member 26 is provided with an axial blind bore which communicates with a drilling 32 and small diameter cross-drillings 34 to provide a route whereby gas bubbles can escape from the control chamber 30, the gas escaping between the piston member 26 and the wall of the bore within which the piston member 26 is slidable to a chamber defined, in part, by an upper surface of the distance piece 24. The bore of the piston member 26 houses a spring abutment member 52, and a spring 54 which is engaged between the spring abutment member 52 and the end surface 28 of the valve needle 10 to bias the needle 10 towards its seating. The spring abutment member 52 acts to reduce the volume of the control chamber 30 available for occupation by fuel under pressure, and also acts to restrict the rate at which fuel can escape from the control chamber 30 through the drilling 32.

The upper surface of the distance piece 24 engages a nozzle holder 36 which is of elongate form, the supply passage 18 extending through the nozzle holder 36 and including a region of enlarged diameter arranged to house an edge filter member 38. The nozzle body 14 and distance piece 24 are secured to the nozzle holder 36 by a cap nut 40 which is in screw-threaded engagement with the nozzle holder 36.

The nozzle holder 36 is provided with an elongate bore 42 which defines a chamber which, in use, communicates with a low pressure drain. A stack 44 of a piezoceramic material is located within the bore 42, a lower end of the stack 44 engaging an anvil member 46 which abuts the upper end of the piston member 26. The stack 44 is made up of a plurality of actuators of the energise to extend (D33) type.

The stack 44 is electrically connected to an appropriate drive circuit 48 which is intended to be driven from the battery of the vehicle in which the engine and fuel system incorporating the injector is mounted. As illustrated in FIG. 1, the drive circuit 48 includes by-pass resistors 50 which ensure that, when the engine is switched off, the stack 44 remains charged for a sufficiently long duration to allow the fuel pressure within the supply passage 18 and common rail or other source of fuel under pressure to decay permitting safe shut down of the fuel system without resulting in unwanted injection of fuel.

In use, upon starting the engine, the fuel pressure supplied to the supply passage 18 is relatively low, thus the force urging the valve needle 10 away from its seating is low, and the spring 54 is of sufficient strength to ensure that the valve needle 10 is maintained in engagement with its seating at this stage in the operation of the injector. As described hereinbefore, fuel is able to flow between the valve needle 10 and the wall of the bore 12 to flow to the control chamber 30 at a restricted rate. Such flow of fuel increases the fuel pressure acting upon the end surface 28 of the valve needle 10, thus assisting the spring 54 in maintaining the valve needle 10 in engagement with its seating as the fuel pressure within the supply passage 18 increases.

If, at this stage in the operation of the injector, the stack 44 of piezoelectric material has not been energized, energization of the stack 44 urges the piston member 26 to move downward at a rate limited by the rate at which fuel can escape from the control chamber 30, the escaping fuel flowing either between the piston member 26 and the bore within which the piston member 26 is located, or between the valve needle 10 and the wall of the bore 12. The downward movement of the piston member 26 results in the fuel pressure within the control chamber 30 rising, thus ensuring that the valve needle 10 remains in engagement with its seating.

In order to commence injection, the stack 44 is discharged, thus reducing the height of the stack 44 and permitting movement of the piston member 26 in an upward direction. The action of the fuel pressure upon the thrust surfaces 1O*a* of the valve needle 10 urges the valve needle 10 away from its seating, such movement of the valve needle 10 being permitted by the reduction of fuel pressure within the control chamber 30 which occurs as a result of the upward movement of the piston member 26. It will be appreciated that as the piston member 26 is of diameter greater than the diameter of the end surface 28 of the valve needle 10, a relatively small amount of movement of the piston member 26 results in the fuel pressure within the control chamber 30 falling to an extent to permit a relatively large amount of movement of the valve needle 10. The movement of the valve needle 10 permits fuel to flow past the seating to the outlet openings 16.

During injection, fuel leaking between the valve needle 10 and the wall of the bore 12 to the control chamber 30 results in the valve needle 10 moving in a downward direction towards its seating. If injection were to occur for an excessively long duration, this would result in the valve needle 10 moving into engagement with its seating to terminate injection. Clearly, the flow of fuel to the control chamber 30 acts as a safety feature to prevent continuous injection in the event that the stack 44 of piezoceramic material or the associated drive circuit 48 should fail.

In order to terminate injection in normal operation, the stack 44 is re-energized resulting in extension of the stack 44, and hence in the piston member 26 being pushed downwards. Such movement increases the fuel pressure within the control chamber 30 thus increasing the force applied to the valve needle 10 to an extent sufficient to urge the needle 10 into engagement with its seating. As, during injection, fuel flows to the control chamber 30, it will be appreciated that the drop in the position of the needle 10 during injection guarantees that the valve needle 10 is pushed back into engagement with its seating at the termination of injection.

Although the restricted flow path by which fuel flows to the control chamber 30 is defined by the needle 10 and adjacent part of the wall of the bore 12 in the embodiment described hereinbefore, it will be appreciated that a separate drilling may be provided, if desired, to provide such a restricted flow path.

Figure 3:
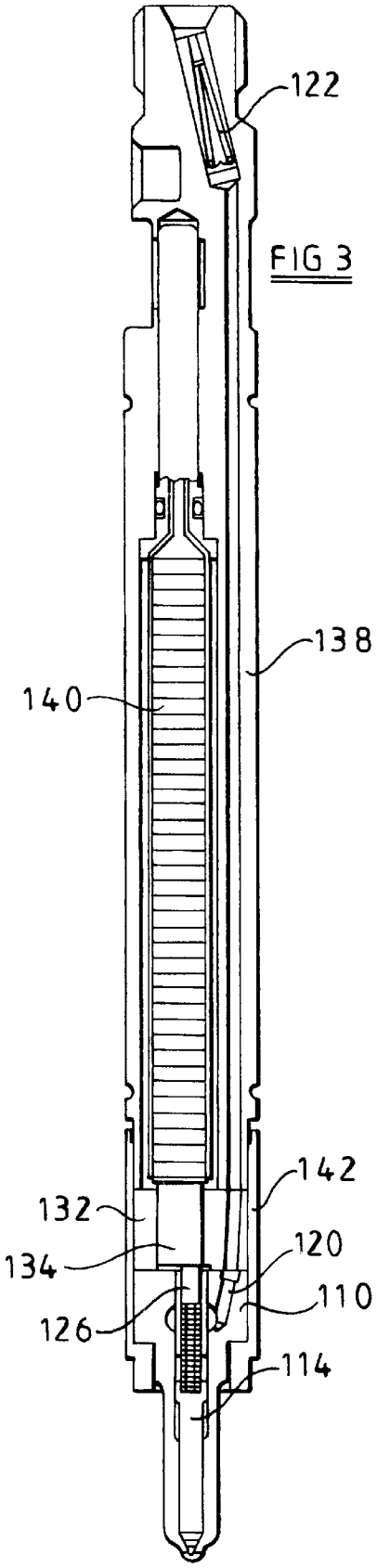
FIG. 3 is a sectional view similar to FIG. 1 of an injector in accordance with another embodiment of the invention.
Figure 4:
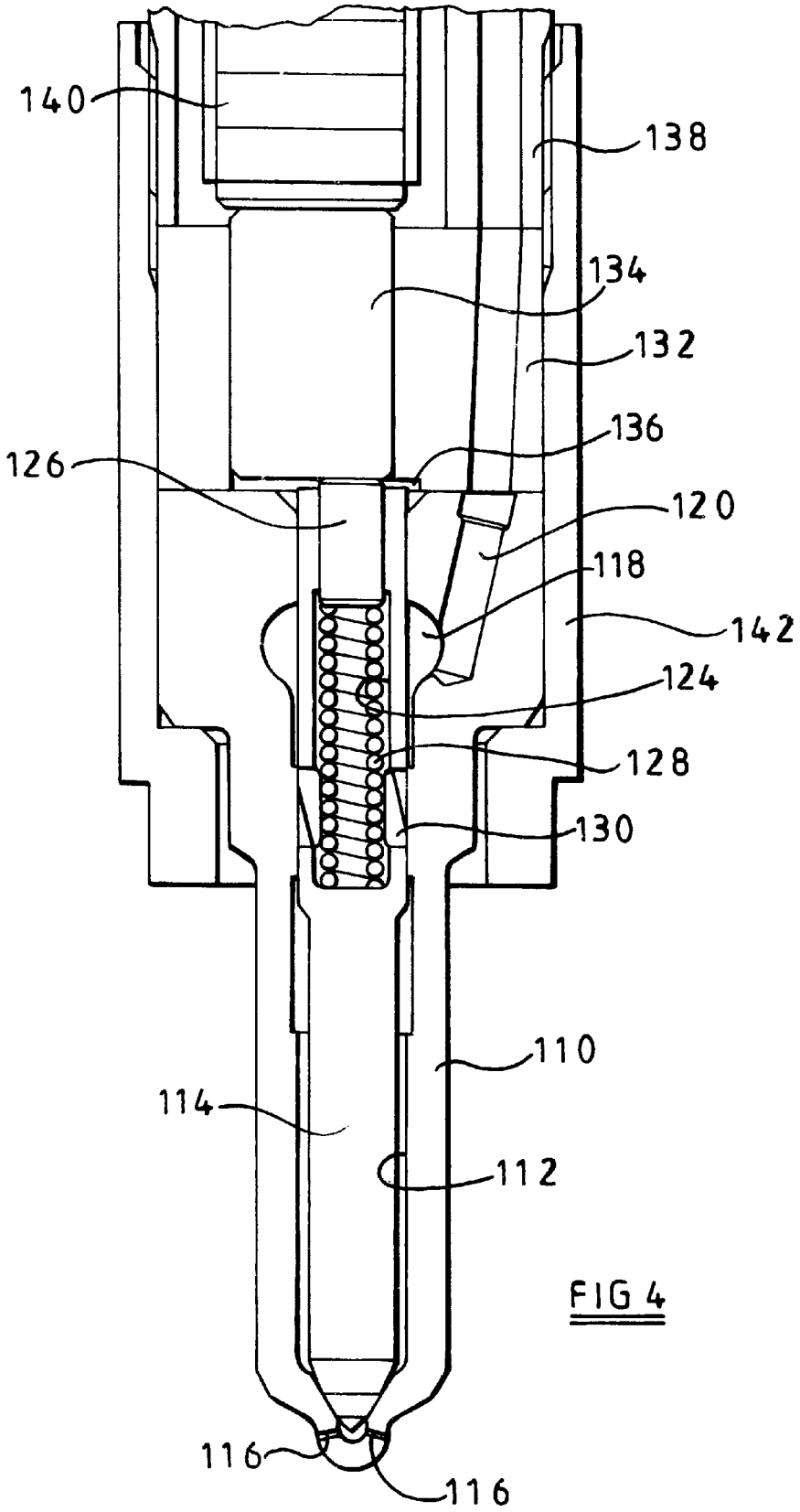
FIG. 4 is an enlargement of part of FIG. 3.

FIGS. 3 and 4 illustrate an alternative fuel injector intended for use in a common rail type fuel supply system for supplying diesel fuel to a cylinder of an associated compression ignition internal combustion engine. The fuel injector comprises a nozzle body 110 having a blind bore 112 formed therein, an injector needle 114 being slidable within the bore 112. The lower end of the needle 114 is shaped to take a frusto-conical form and is arranged to be engageable with a seating defined around a blind end of the bore 112 to control the supply of fuel from the bore 112 to a plurality of outlet openings 116. The bore 112 and needle 114 are shaped to include regions of substantially the same diameter to guide sliding movement of the needle 114 within the bore 112. The bore 112 is further shaped to define an annular gallery 118 which communicates with a supply passage 120 through which fuel under high pressure from the common rail is delivered to the bore 112. As illustrated in FIG. 3, the supply passage 120 is conveniently shaped to include a region of enlarged diameter within which an edge filter member 122 is located.

In order to permit fuel to flow from the annular gallery 118 towards the blind end of the bore 1 12, the valve needle 1 14 is conveniently provided with external flutes. The end of the needle 114 remote from the frusto-conical end is provided with an axially extending blind bore 124 within which a shield member 126 in the form of a piston is slidable. A spring 128 is engaged between the shield member 126 and a surface of the needle 114 within the bore 124. The needle 114 is further provided with openings 130 whereby fuel is able to flow from the fluted region of the needle 114 to the bore 124.

The upper end of the nozzle body 1 10 engages a distance piece 132 which is provided with a through bore which is located eccentric to the axis of the distance piece 132. A piston member 134 is located within the through bore, and the spring 128 biases the shield member 126 into engagement with the piston member 134. As illustrated most clearly in FIG. 4, the shield member 126, the piston member 134, the bore provided in the distance piece 132 and the upper end surface of the valve needle 114 together define a control chamber 136. It will be appreciated that the area of the part of the valve needle 1 14 exposed to the fuel pressure within the control chamber 136 is relatively small and is of generally annular shape. In particular, the effective area of the valve needle 114 exposed to the fuel pressure within the control chamber 136 is smaller than the area of the piston member 134 exposed to the fuel pressure within the control chamber 136. As a result, movement of the piston member 134 through a predetermined distance results in movement of the valve needle 114 through a greater distance whilst maintaining the volume of the control chamber 136 at a substantially fixed volume.

The upper surface of the distance piece 132 abuts the lower end of a nozzle holder 138 which is provided with a bore housing a piezoelectric actuator 140 comprising a stack of piezoceramic material, the lower end of which abuts the upper surface of the piston member 134. An anvil member may be located therebetween if desired. A cap nut 142 is arranged to secure the nozzle body 110 and distance piece 132 to the nozzle holder 138.

In use, with the supply passage 120 supplied with fuel under high pressure from a common rail, and with the actuator 140 extended and pushing the piston 134 in a downward direction, the fuel pressure applied to the thrust surfaces of the needle 114 urging the valve needle 114 away from its seating is opposed by the combination of the fuel pressure within the bore 124, the action of the spring 128, and the fuel pressure within the control chamber 136 acting upon the exposed end surface of the valve needle 114, with the result that the valve needle 114 is held in engagement with its seating thus fuel supply from the bore 112 to the outlet openings 116 does not occur, and injection does not take place.

In order to commence injection, the actuator 140 is operated to reduce the length thereof, permitting the piston member 134 to move upwards under the influence of the fuel pressure within the control chamber 136 and under the influence of the spring 128. The movement of the piston member 134 reduces the fuel pressure within the control chamber 136, thus reducing the downward force applied to the needle 114, and a point will be reached beyond which the needle 114 can lift from its seating. As described hereinbefore, as the effective area of the valve needle 114 exposed to the fuel pressure within the control chamber 136 is relatively low, movement of the piston member 134 through a relatively small distance results in movement of the valve needle 114 through a relatively large distance without significantly altering the fuel pressure within the control chamber 136. As a result, for a given size of actuator 140 and piston member 134, the valve needle 114 is permitted to travel through an increased distance.

In order to terminate injection, the actuator 140 is operated to cause downward movement of the piston member 134 increasing the fuel pressure within the control chamber 136 thus increasing the downward force applied to the valve needle 114, and it will be appreciated that a point will be reached beyond which the fuel pressure within the control chamber 136 is sufficient to cause the valve needle 114 to move into engagement with its seating, thus terminating injection. It will be appreciated that the area of the piston member 134 over which fuel acts is limited as part of the end surface of the piston member 134 is covered or obscured by the shield member 126. The force applied to the needle is still sufficient to cause reasonably rapid closure of the injector.

Figure 5:
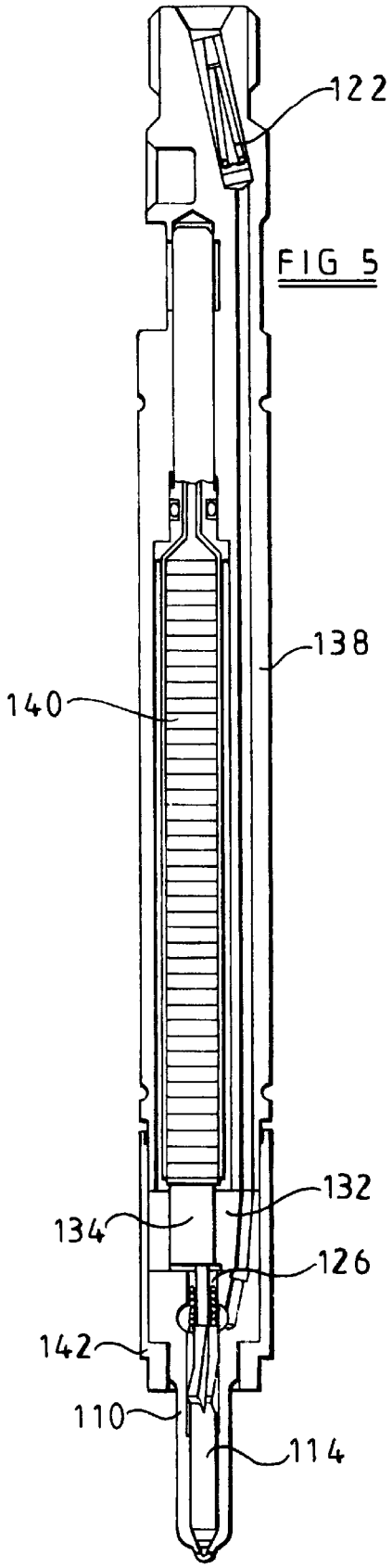
FIG. 5 is a view similar to FIG. 1 illustrating an alternative embodiment.
Figure 6:
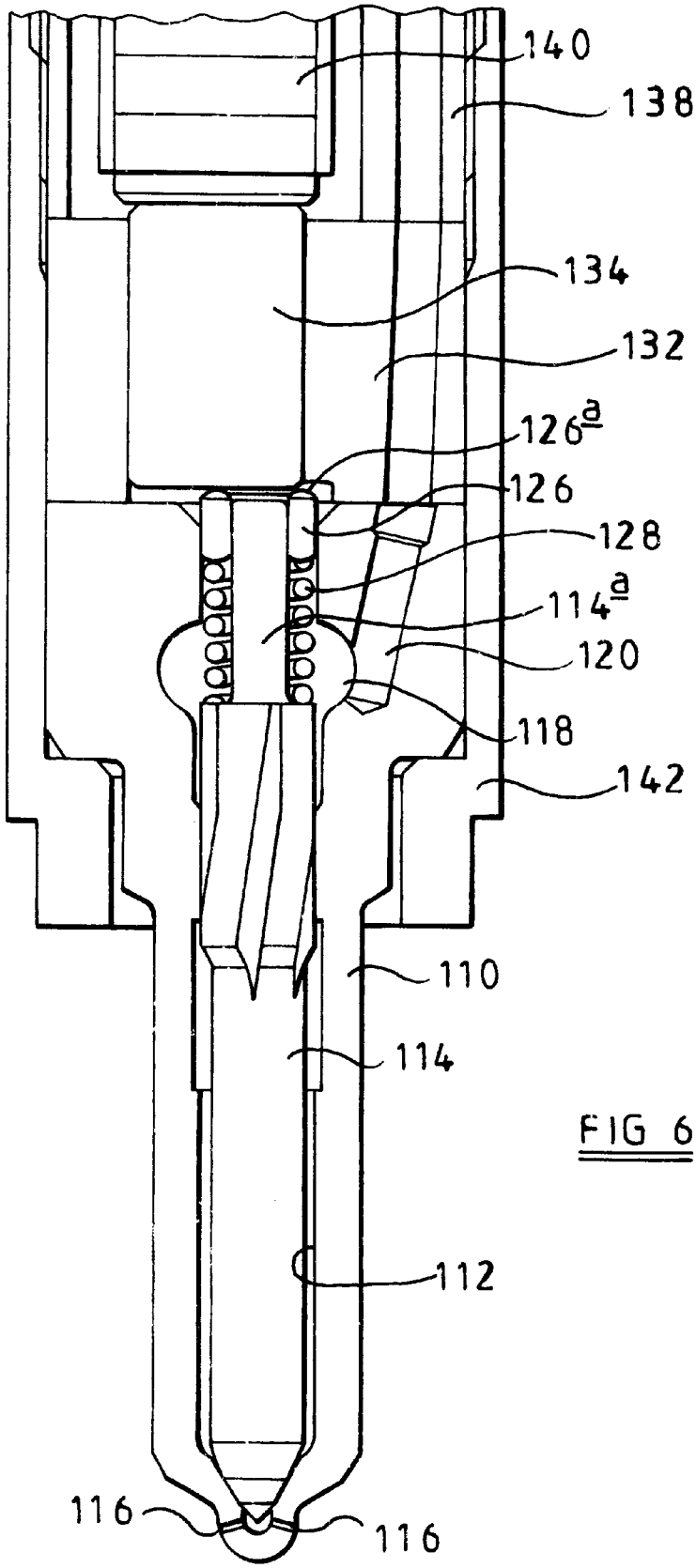
FIG. 6 is an enlargement of part of FIG. 5.

The arrangement illustrated in FIGS. 5 and 6 differs from that of FIGS. 3 and 4 in that the valve needle 114 is not provided with an axially extending blind bore, and instead includes an extension 114*a* of reduced diameter. In this embodiment, the shield member 126 takes the form of an annular sleeve which is located around the extension 114*a*, the spring 128 being engaged between the annular shield member 126 and a surface of the valve needle 114.

The upper end surface of the annular shield member 126 is provided with grooves 126*a* which define flow passages permitting fuel within the control chamber 136 to act upon the end surface of the extension 114*a*.

Operation of this embodiment is similar to that described with reference to FIGS. 3 and 4 and will not be described in further detail. It will be appreciated, however, that the use of an annular shield member 126 surrounding part of the extension 114*a* rather than the provision of a bore 124 in the valve needle 114 results in the loss of one of the guide surfaces for the injector needle 114, and as a result, the concentricity of the extension 114*a* and the annular shield member 126 must be high in order to provide accurate guiding of the movement of the valve needle 114, in use.

Figure 7:
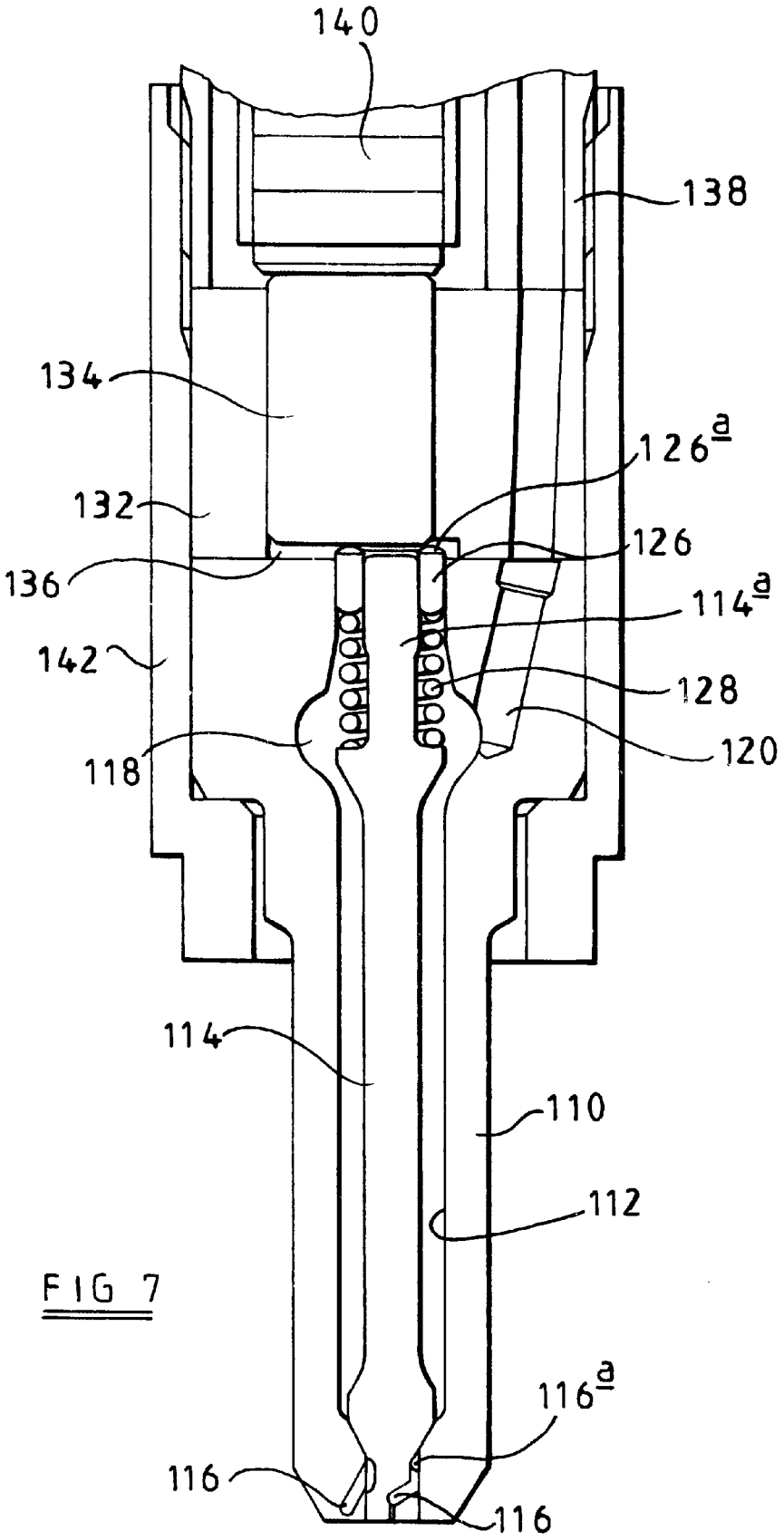
FIGS. 7 to 9 are views similar to FIGS. 4 and 6 illustrating further embodiments.

The arrangement illustrated in FIG. 7 is similar to that of FIG. 6, but the lower end of the valve needle 114 is located within a continuation of the bore 112 to guide the lower end of the valve needle 1 14, the engagement of the valve needle 114 with its seating controlling the supply of fuel to a lower chamber 116*a* defined between the valve needle 114 and nozzle body 110, the chamber 116*a* communicating with outlet openings 116 provided both in the nozzle body 110 and in the lower end of the valve needle 114. As the lower end of the valve needle 114 is guided for sliding movement, the accuracy of the concentricity of the extension 114*a* and annular shield member 126 can be reduced. Operation of this embodiment is similar to that described with reference to FIGS. 3 and 4, and will not be described in further detail.

Figure 8:
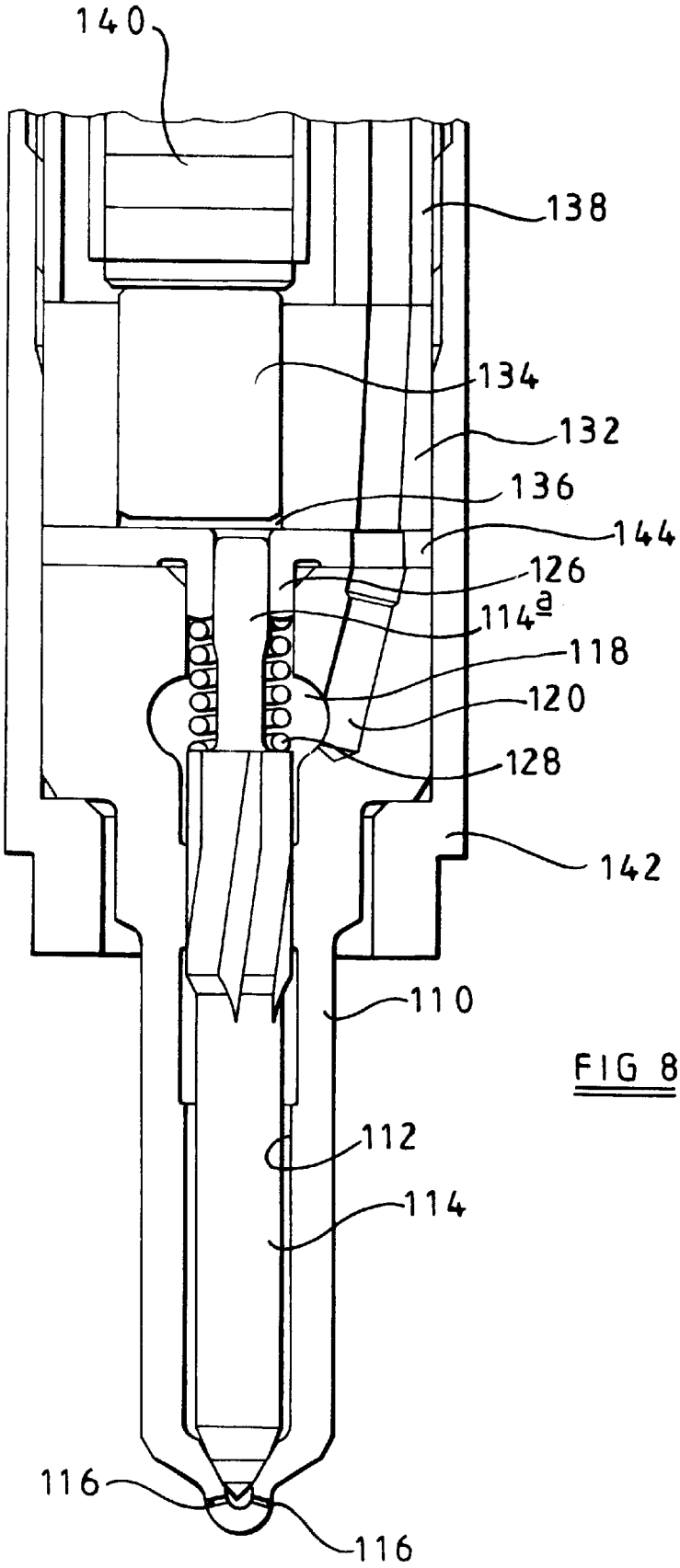
Figure 9:
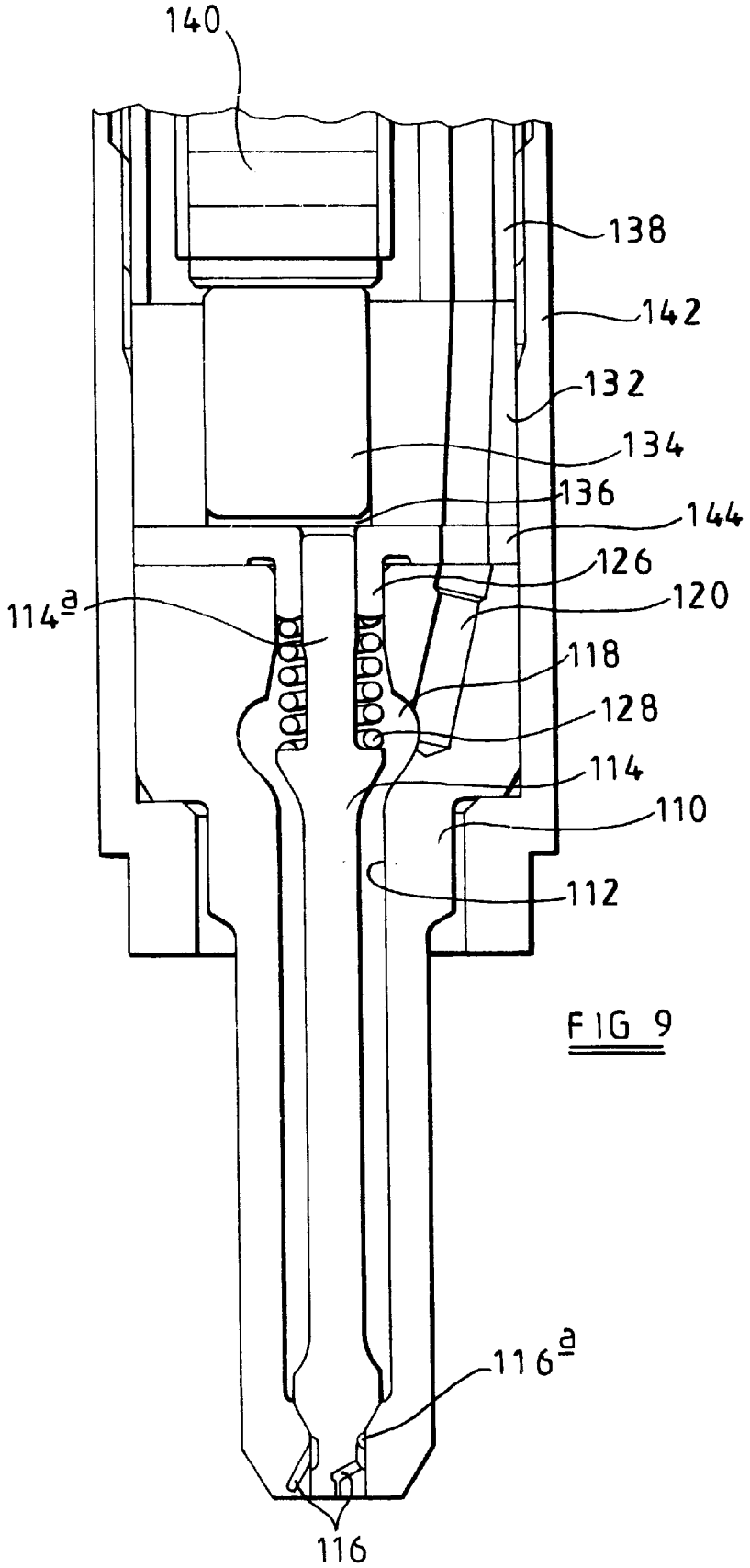

In the embodiments described hereinbefore with reference to FIGS. 3 to 7, the shield member 126 is arranged to engage the lower end surface of the piston member 134. This has the disadvantage that the area of the piston member 134 exposed to the fuel pressure within the control chamber 136 is reduced, and thus although in the arrangements described hereinbefore, the movement of the valve needle 114 as compared to that of the piston member 134 is amplified, it may be advantageous to provide an arrangement in which the shield member 126 does not engage the lower end of the piston member 134. FIGS. 8 and 9 illustrate arrangements similar to FIGS. 6 and 7 but in which the shield members 126 form part of a second distance piece 144 which is located between the first distance piece 132 and the nozzle body 110. As described hereinbefore, the concentricity of the arrangement of FIG. 9 is less critical than it is in the arrangement of FIG. 8. As an alternative to the provision of the shield member 126 as part of a second distance piece 144, the shield member 126 may be secured directly to the nozzle body 110, for example using appropriate screws or by welding. It will be appreciated that other techniques may be used to secure the shield member to the nozzle body 110.

It will be appreciated that the arrangements illustrated in FIGS. 7 and 9 are particularly advantageous in that the valve needles 114 thereof are substantially fuel pressure balanced, in use, and thus the force which must be applied to the valve needle 114 in order to move it towards or away from its seating is reduced. As a result, a greater level of needle movement can be achieved for a given size of piezo-stack and piston member 134.

In the arrangements described hereinbefore with reference to FIGS. 3 to 9, the valve needle and nozzle body may form a substantially fluid tight seal, substantially preventing fuel from flowing to or from the control chamber, and if desired, an alternative fluid may be provided within the control chamber. It will be appreciated that fuel may be permitted to flow to the control chamber at a restricted rate, if desired, thereby lubricating the valve needle, compensating for variations in the length of the actuator, for example resulting from temperature changes, and acting to terminate injection in the event that the actuator fails during injection, as described hereinbefore with reference to FIGS. 1 and 2. It will further be appreciated that the injectors described with reference to FIGS. 3 to 9 may be controlled using the drive circuit illustrated in FIG. 1.

What is claimed is:

1. A fuel injector comprising a valve needle slidable within a bore and engageable with a seating to control the supply of fuel to an outlet opening, a surface associated with the valve needle being exposed to the fuel pressure within a control chamber defined, in part, by a first piston member moveable under the influence of a piezoelectric actuator, wherein the effective area of the first piston member exposed to the fuel pressure within the control chamber is greater than the corresponding area of said surface associated with the valve needle, the fuel injector further comprising a shield member shielding, in use, part of the valve needle from the fuel pressure within the control chamber, the shield member including a sleeve through which part of the valve needle extends.

2. A fuel injector as claimed in claim 1, wherein the sleeve is moveable with the first piston member.

3. A fuel injector comprising a valve needle slidable within a bore and engageable with a seating to control the supply of fuel to an outlet opening, a surface associated with the valve needle being exposed to the fuel pressure within a control chamber defined, in part, by a first piston member moveable under the influence of a piezoelectric actuator, wherein the effective area of the first piston member exposed to the fuel pressure within the control chamber is greater than the corresponding area of the said surface associated with the valve needle, the fuel injector further comprising a shield member, a part of the shield member being in contact with the valve needle so as to shield part of the valve needle from the fuel pressure within the control chamber.

4. A fuel injector as claimed in claim 3, wherein the control chamber is supplied with fuel under pressure, in use, through a restricted flow path.

5. A fuel injector as claimed in claim 4, wherein the restricted flow path comprises a controlled leakage path defined between the valve needle and the bore.

* * * * *